US008027621B2

(12) United States Patent
Isomura et al.

(10) Patent No.: US 8,027,621 B2
(45) Date of Patent: Sep. 27, 2011

(54) DEVELOPER SUPPLY CASE AND IMAGE FORMING APPARATUS

(75) Inventors: Tetsuo Isomura, Kashiwa (JP); Teruaki Tsurusaki, Moriya (JP); Yukihiro Kitozaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/052,455

(22) Filed: Mar. 21, 2011

(65) Prior Publication Data

US 2011/0164898 A1 Jul. 7, 2011

Related U.S. Application Data

(62) Division of application No. 12/031,378, filed on Feb. 14, 2008, now Pat. No. 7,953,351.

(30) Foreign Application Priority Data

Feb. 21, 2007 (JP) ..... 2007-040158

(51) Int. Cl.
*G03G 15/08* (2006.01)

(52) U.S. Cl. ..... 399/258; 399/120; 399/262

(58) Field of Classification Search ..... 399/120, 399/258, 262
See application file for complete search history.

(56) References Cited

U.S. PATENT DOCUMENTS

| | | | |
|---|---|---|---|
| 5,812,914 | A | 9/1998 | Johroku |
| 6,292,644 | B1 | 9/2001 | Goto et al. |
| 6,418,290 | B1 | 7/2002 | Isomura et al. |
| 6,704,533 | B2 | 3/2004 | Isomura et al. |
| 6,788,912 | B2 | 9/2004 | Isomura et al. |
| 6,839,533 | B2 | 1/2005 | Ban et al. |
| 6,871,588 | B2 | 3/2005 | Sasaki et al. |
| 6,963,713 | B2 | 11/2005 | Isomura et al. |
| 6,980,754 | B2 | 12/2005 | Isomura et al. |
| 6,985,686 | B2 | 1/2006 | Okino et al. |
| 6,987,942 | B2 | 1/2006 | Yoshikawa et al. |
| 7,054,581 | B2 | 5/2006 | Yoshikawa et al. |
| 7,190,925 | B2 | 3/2007 | Isomura et al. |
| 7,369,798 | B2 | 5/2008 | Sasae et al. |
| 7,486,915 | B2 | 2/2009 | Koyama et al. |

(Continued)

FOREIGN PATENT DOCUMENTS

| | | | |
|---|---|---|---|
| EP | 0856780 | A1 | 8/1998 |

(Continued)

OTHER PUBLICATIONS

European Search Report dated Dec. 8, 2008 in counterpart European Application No. 08151688.2-2209.
Notice of Preliminary Rejection dated Sep. 30, 2009, in counterpart Korean Application No. 10-2008-0015300.

*Primary Examiner* — David Gray
*Assistant Examiner* — Francis Gray
(74) *Attorney, Agent, or Firm* — Fitzpatrick, Cella, Harper & Scinto

(57) ABSTRACT

A developer supply case which is detachably attachable to an inserted portion of an image forming apparatus body includes a case body which stores a developer in its inside; an engaging portion which causes an inserting load W when engaged with an engaged portion provided in the image forming apparatus at completion of insertion of the developer supply case into the inserted portion; and a load causing portion which is provided so as to abut part of the inserted portion in insertion of the developer supply case into the inserted portion and causes an inserting load P1 before the engaging portion is engaged with the engaged portion, wherein the inserting load W and the inserting load P1 satisfy the following relation: P1≧W.

8 Claims, 19 Drawing Sheets

U.S. PATENT DOCUMENTS

| | | | | |
|---|---|---|---|---|
| 2004/0131391 | A1* | 7/2004 | Nagashiro | 399/258 |
| 2005/0047828 | A1 | 3/2005 | Kawai | |
| 2005/0271426 | A1 | 12/2005 | Okino et al. | |
| 2006/0104658 | A1 | 5/2006 | Tsurusaki | |
| 2006/0104663 | A1 | 5/2006 | Kitozaki | |
| 2007/0086810 | A1* | 4/2007 | Yamada et al. | 399/258 |
| 2007/0223972 | A1 | 9/2007 | Isomura | |
| 2007/0286646 | A1 | 12/2007 | Ichikawa et al. | |
| 2008/0213004 | A1 | 9/2008 | Sasae et al. | |
| 2008/0260422 | A1 | 10/2008 | Sasae et al. | |

FOREIGN PATENT DOCUMENTS

| | | | |
|---|---|---|---|
| EP | 0897138 | A1 | 2/1999 |
| JP | 9-90729 | A | 4/1997 |
| JP | 2000-162861 | A | 6/2000 |
| JP | 2005-70406 | A | 3/2005 |
| JP | 2007-33783 | A | 2/2007 |

* cited by examiner

DEVELOPER SUPPLY CASE AND IMAGE FORMING APPARATUS

This application is a divisional of U.S. patent application No. 12/031,378, filed Feb.14, 2008.

BACKGROUND OF THE INVENTION

1. Field of the Invention

The present invention relates to a developer supply case which supplies a developer to an image forming apparatus such as an electrophotograph copying machine or a printer and an image forming apparatus to which the developer supply case is attachable.

2. Description of the Related Art

In a related art, a powdered developer is used as a developer for an image forming apparatus such as an electrophotograph copying machine or a printer. When the developer of the image forming apparatus is consumed, it is supplied to the image forming apparatus using a developer supply case.

The very fine powdered developer is scattered in the developer supplying operation, making the operator and surroundings dirty.

In recent years, a developer supply case is mostly used which is inserted into the image forming apparatus without opening its discharge port which is to be opened by operating an operation portion provided separately, and which supplies the stored developer to the image forming apparatus.

The developer supply case of the above constitution cannot supply the developer unless the discharge port opening operation is performed in the state that the discharge port of the developer supply case and the developer receiving port of the image forming apparatus body coincide with each other. Otherwise, the developer is scattered in the image forming apparatus body, making its interior dirty.

The discharge port of the developer supply case and the developer receiving port of the image forming apparatus body need to surely coincide with each other. As one method, in general, the developer supply case is completely inserted into the image forming apparatus so that the discharge port of the developer supply case and the developer receiving port of the image forming apparatus coincide with each other in size.

There has also been known a constitution in which a lock mechanism is provided in a sealing member which seals the discharge port of the developer supply case and is released after the developer supply case is inserted into the image forming apparatus body so that the discharge port of the developer supply case and the developer receiving port of the image forming apparatus body coincide with each other. In the position where the lock is released to open the discharge port, the discharge port of the developer supply case and the developer receiving port of the image forming apparatus body coincide with each other. This enables supply of the developer and prevents scattering of the developer in the image forming apparatus, which makes its interior dirty.

The developer supply case having the sealing member, as described above, is disclosed in Japanese Patent Application Laid-Open (JP-A) No. 2000-162861. A case shutter which seals the discharge port of the developer supply case can be slid in two directions. The case shutter can be slid in two directions so that it is slid in one direction and in the other direction. When the developer supply case is inserted into the image forming apparatus body, the case shutter abuts an engaging member provided in the image forming apparatus body so that it is slid in one direction. The case shutter can be slid in the other direction (shutter opening direction). The position of the discharge port of the developer supply case and the position of the developer receiving port of the image forming apparatus coincide with each other in the inserting direction. The shutter is opened in this state so that the discharge port of the developer supply case and the developer receiving port of the image forming apparatus coincide with each other.

In the constitution disclosed in JP-A No. 2000-162861, the developer supply case is inserted into the image forming apparatus body against an elastic member provided in the case shutter. Due to increase of the inserting force by the elastic force of the elastic member, the user can misunderstand that insertion of the developer supply case is completed and stop the inserting operation in the position. When the shutter is opened in this state, the shutter is regulated by the lock member provided in the shutter so as not to be slid. The user cannot open the developer supply case so that the developer cannot be supplied.

A constitution which promotes the inserting operation with respect to load variation during the inserting operation of the developer supply case is disclosed by Japanese Patent Application Laid-Open (JP-A) No. 9-90729.

JP-A No. 9-90729 discloses the constitution which has an exciting spring in a bottle holder of the image forming apparatus body so that the spring force of the exciting spring is larger than the operating force caused when the stopper of a toner bottle is fitted into the toner bottle.

The constitution disclosed in JP-A No. 9-90729 can be achieved by the rotation controlled bottle holder. It is not applicable to the constitution of front access in which the developer supply case is pushed into the front side of the image forming apparatus body for attachment. The constitution which uses the exciting spring increases the number of parts. The cost becomes a large burden on the constitution.

The developer supply case has been designed such that its inserting force is minimum. It has been considered that the reduced inserting force improves the operability of the developer supply case.

SUMMARY OF THE INVENTION

The present invention prevents the false operation of the user and ensures reliable insertion of a developer supply case into an inserted portion.

A developer supply case which is detachably attachable to an inserted portion of an image forming apparatus body in order to achieve the above object, includes a case body which stores a developer in its inside; an engaging portion which causes an inserting load W when engaged with an engaged portion provided in the image forming apparatus at completion of insertion of the developer supply case into the inserted portion; and a load causing portion which is provided so as to abut part of the inserted portion in insertion of the developer supply case into the inserted portion and causes an inserting load P1 before the engaging portion is engaged with the engaged portion; wherein the inserting load W and the inserting load P1 satisfy the following relation: $P1 \geqq W$.

An image forming apparatus in order to achieve the above object, includes an image bearing member on which an electrostatic image is formed; a development device which develops the electrostatic image by a developer; an inserted portion to which a developer supply case which stores the developer to be supplied to the development device is detachably attachable; and an engaged portion which causes an inserting load W when engaged with an engaging portion provided in the developer supply case at completion of insertion of the developer supply case into the inserted portion; wherein the inserted portion has a portion which abuts a load causing portion provided in the developer supply case in insertion of the developer supply case into the inserted portion and causes an inserting load P1 before the engaging portion is engaged with the engaged portion; wherein the inserting load W and the inserting load P1 satisfy the following relation: P1≧W.

Further features of the present invention will become apparent from the following description of exemplary embodiments (with reference to the attached drawings).

BRIEF DESCRIPTION OF THE DRAWINGS

FIGS. 3A and 3B are perspective views of a hopper according to the first embodiment, in which FIG. 3A illustrates the state that a hopper shutter 11 is sealed and FIG. 3B illustrates the state that the hopper shutter is opened;

FIGS. 8A, 8B, and 8C are diagrams illustrating the state of inserting the developer supply case according to the first embodiment into the hopper, in which FIG. 8A is a perspective view illustrating the state while the developer supply case is being inserted, FIG. 8B is a perspective view illustrating the state after the developer supply case abuts and is inserted into the hopper, FIG. 8C is a perspective view illustrating the state after the handle 5 is rotated;

FIGS. 9A and 9B are diagrams illustrating the state of fitting a positioning pin and a positioning hole to each other in insertion of the developer supply case according to the first embodiment into the hopper, in which FIG. 9A illustrates the state while the developer supply case is being inserted into the hopper and FIG. 9B illustrates the state after the developer supply case is inserted into the hopper;

FIGS. 10A, 10B, and 10C are diagrams illustrating the state of releasing and rotating a handle lock according to the first embodiment, in which FIG. 10A illustrates the state before the handle lock is released, FIG. 10B illustrates the state after the handle lock is released, and FIG. 10C illustrates the state after the handle is rotated;

FIGS. 11A, 11B, and 11C are diagrams illustrating the state of attaching and rotating the shutter according to the first embodiment, in which FIG. 11A illustrates the state while the shutter is being attached, FIG. 11B illustrates the state after the shutter is attached, and FIG. 11C illustrates the state after the shutter is rotated;

FIGS. 12A, 12B, and 12C are cross-sectional views illustrating the state of the interference between a step rib 2-11 and a positioning rib 19, in which FIG. 12A illustrates the state while the developer supply case is being inserted (tall rib interference start state), FIG. 12B illustrates the state while the developer supply case is being inserted (tall rib interference end state), and FIG. 12C illustrates the state after the developer supply case is inserted;

FIGS. 19A, 19B, and 19C are diagrams illustrating the state of releasing the shutter lock of the developer supply case 1 according to the second embodiment, in which FIG. 19A illustrates the state before the shutter lock is released, FIG. 19B illustrates the state after the shutter lock is released, and FIG. 19C illustrates the state after the shutter is rotated.

DESCRIPTION OF THE EMBODIMENTS

A developer supply case according to the present invention will be described below with an image forming apparatus having the same inserted thereinto with reference to the drawings.

First Embodiment

The constitution of an electrophotograph copying machine as an example of an image forming apparatus which employs electrophotography and has a developer supply case according to a first embodiment inserted thereinto will be described based on FIG. 1.

[Overall Constitution of the Image Forming Apparatus]

Figure 1:
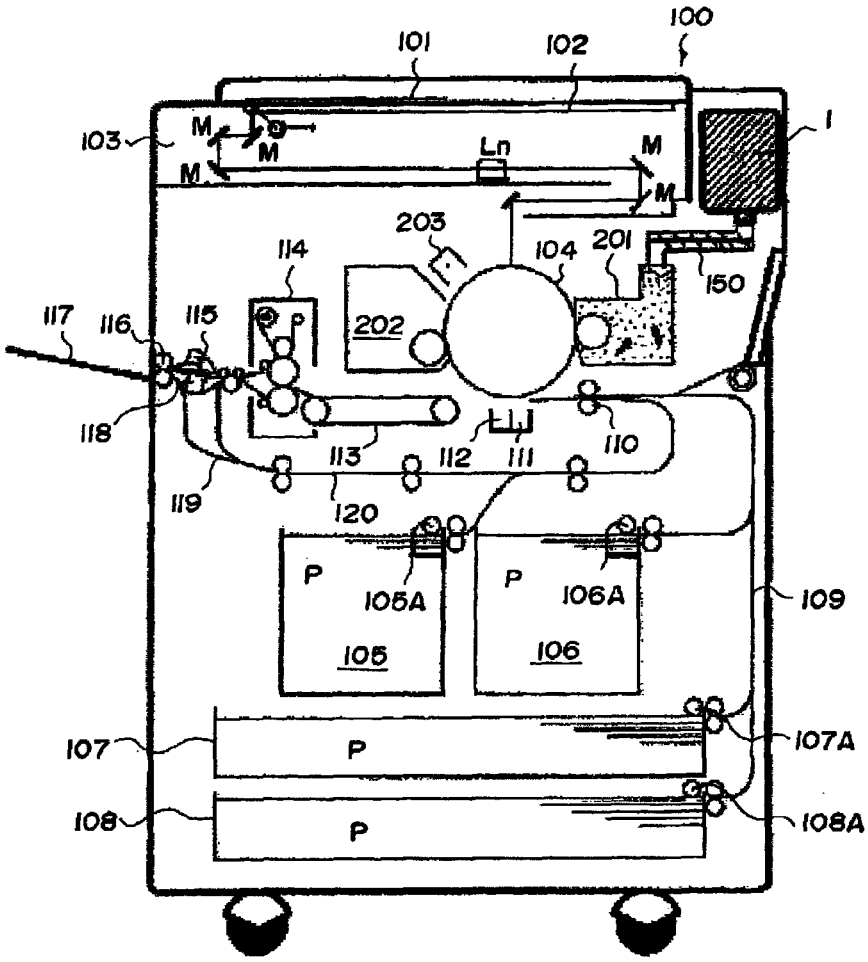
FIG. 1 is a diagram illustrating the constitution of an electrophotograph image forming apparatus.

In FIG. 1, in an electrophotograph copying apparatus body (hereinafter, called an "apparatus body") 100, an original 101 is placed on a document glass 102 and a plurality of mirrors M and a lens Ln of an optical portion 103 are arranged in such a manner that image information is imaged on a photosensitive drum 104 as an image bearing member. Of sheets P stacked on sheet cassettes 105, 106, 107, and 108, the sheet which is most suitable for information input by the user from an operation portion (not illustrated) or the sheet size of the original 101 is selected according to the sheet size information of the sheet cassettes 105 to 108.

One of the sheets P conveyed by feeding and separating devices 105A, 106A, 107A, and 108A is conveyed to a registration roller 110 via a conveying portion 109 by synchronizing rotation of the photosensitive drum 104 with scan timing of the optical portion 103. The apparatus body 100 includes transfer and separating chargers 111 and 112.

A developer T is fixed on the sheet P conveyed by a conveying portion 113 by heat and pressure by a fixing portion 114. In the case of single-sided copy, the sheet P passes through a discharge inverting portion 115 and is then discharged to a discharge tray 117 by a discharge roller 116. In the case of duplex copy, the sheet P is conveyed to the registration roller 110 via refeeding conveying paths 119 and 120 by control of a flapper 118 of the discharge inverting portion 115 and follows the same path as that of single-sided copy so as to be discharged to the discharge tray 117.

In the apparatus body 100 of the above constitution, a development device 201, a cleaner portion 202, and a charger 203 are arranged around the photosensitive drum 104. Here, the development device 201 absorbs the developer T onto the photosensitive drum 104 in order to make information on the original 101 imaged as an electrostatic image onto the photosensitive drum 104 by the optical portion 103 apparent. The developer supply case 1 which supplies the developer T to the development device 201 via a supply conveying member 150 is detachably attachable to the apparatus body 100.

[Developer Supply Case]

Figure 2A:
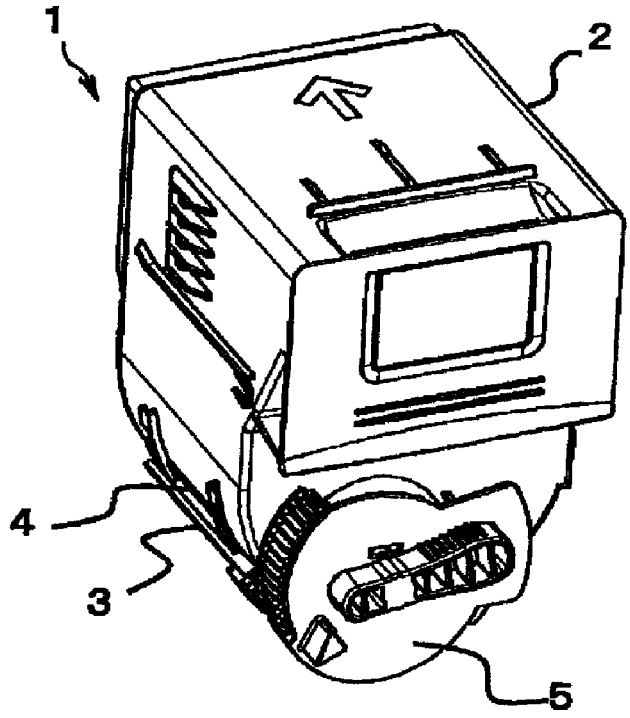
FIG. 2A is a front perspective view of a developer supply case according to a first embodiment and FIG. 2B is a rear perspective view of the developer supply case according to the first embodiment.
Figure 2B:
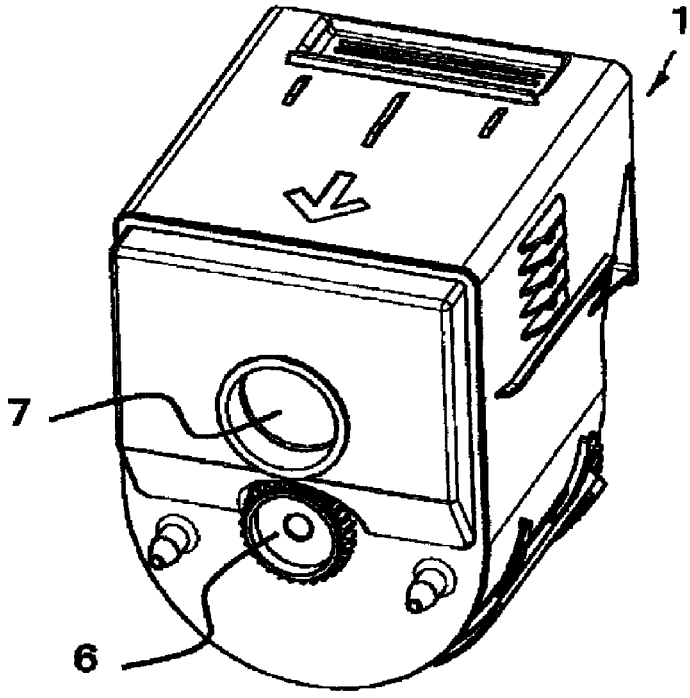

The constitution of the developer supply case 1 will be described. FIGS. 2A and 2B are perspective views of the developer supply case, in which FIG. 2A is a front perspective view of the developer supply case 1 and FIG. 2B is a rear perspective view of the developer supply case 1. The developer supply case 1 illustrated in this embodiment has a case body 2, a shutter 3, a packing material 4, a handle 5, a coupling 6, and an inside stopper 7.

Figure 3A:
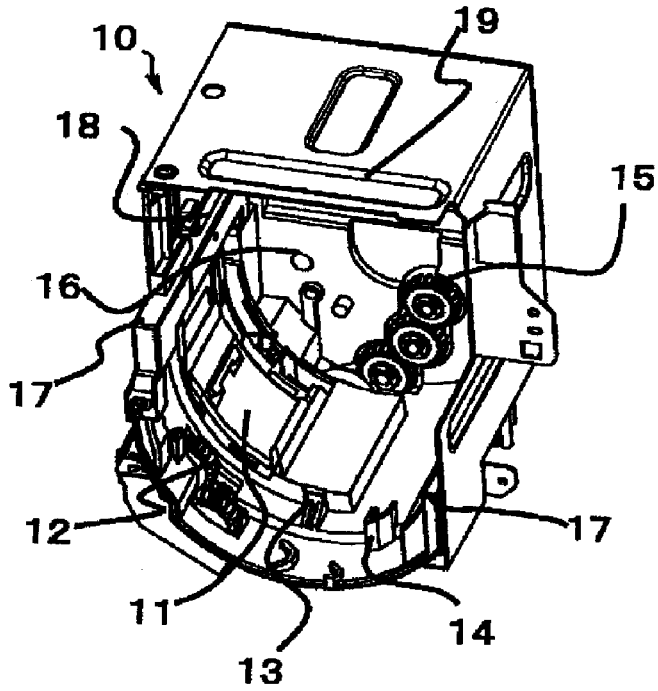
Figure 3B:
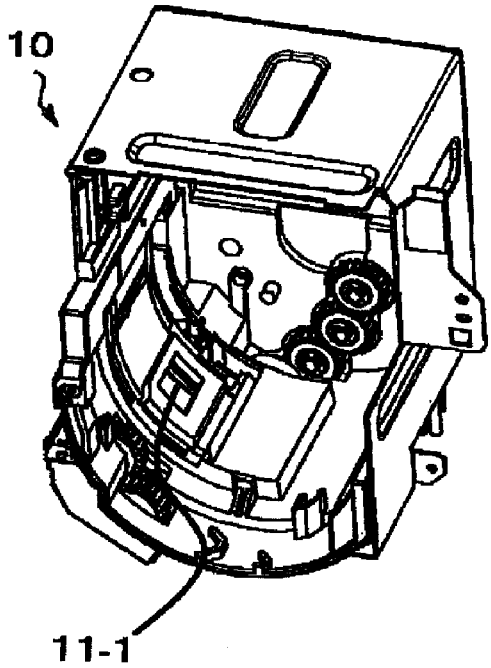

FIGS. 3A and FIG. 3B are front perspective views of a developer receiving hopper (hereinafter, called a "hopper") as an inserted portion to which the developer supply case 1 is detachably attachable. FIG. 3A illustrates the state that a hopper shutter is in the sealing position, and FIG. 3B illustrates the state that the hopper shutter is in the opening position.

A hopper 10 has a hopper shutter 11, a drive relay gear 12, projections 13 and 14, an agitating gear 15, a positioning hole 16, a case guide 17, an incompatible attachment 18, and a positioning rib 19. The hopper shutter 11 has a developer receiving opening 11-1.

(Case Body)

Figure 4A:
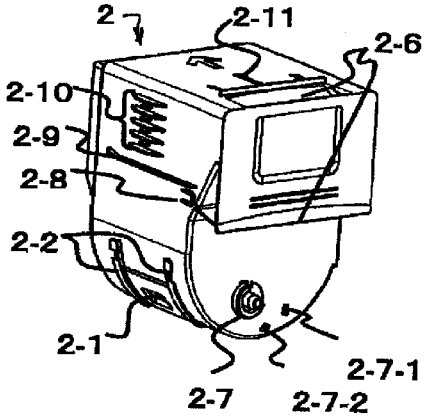
FIG. 4A is a front perspective view of a case body according to the first embodiment and FIG. 4B is a rear perspective view of the case body according to the first embodiment.
Figure 4B:
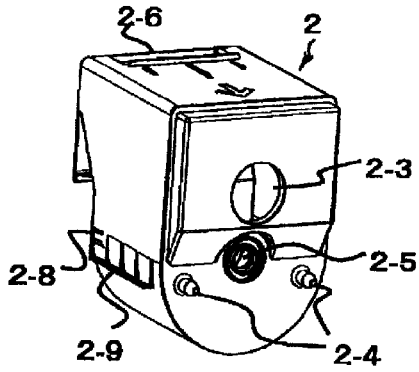

The case body 2 will be described using FIGS. 4A and 4B. FIG. 4A is a front perspective view of the case body 2, and FIG. 4B is a rear perspective view of the case body 2.

The case body 2 has in its bottom portion a supply opening 2-1 and a shutter guide rail 2-2. The case body 2 has on one end face a filling port 2-3, a positioning pin 2-4, and a coupling hole 2-5. An end face on the opposite side of the case body 2 has a holding portion 2-6 and a handle mounting portion 2-7. The case body 2 has on both side surfaces a positioning rib 2-8, a guide rail 2-9, and an incompatible rib 2-10, and has on the top surface a step rib 2-11.

The supply opening 2-1 is an opening which supplies the developer stored in the case body 2 to the hopper 10 and is sealed by compressing the packing material 4 (see FIG. 2A) provided around the supply opening 2-1 by the shutter 3 as a sealing member. In the sealed state, the developer stored in the case body 2 cannot be leaked from the supply opening 2-1.

The shutter guide rail 2-2 is a rail which slidably fixes the shutter 3. The filling port 2-3 is used for filling the developer into the case body 2. The developer is filled into the case body 2 through the filling port 2-3. The filling port 2-3 is then sealed by the inside stopper 7.

The positioning pins 2-4 which are engaging portions which fix the developer supply case 1 to the hopper 10 are provided on the right and left sides of the end face provided with the filling port 2-3. The positioning pin 2-4 and the positioning hole 16 as an engaged portion of the hopper 10 are engaged with each other. The developer supply case 1 is then positioned in and fixed to the hopper 10.

The coupling hole 2-5 is provided on the end face provided with the filling port 2-3. The coupling 6 is rotatably and axially supported in the coupling hole 2-5. A shaft seal member such as an oil seal may be provided around the coupling hole 2-5.

The holding portion 2-6 for the user to hold the developer supply case 1 at its insertion into the hopper 10 is provided on the opposite side of the end face provided with the filling port 2-3. The user holds the holding portion 2-6 to insert the developer supply case 1 into the hopper 10.

The handle mounting portion 2-7, a handle lock opening engaged portion 2-7-1, and a handle lock sealing engaged portion 2-7-2 are provided on the end face provided with the holding portion 2-6. The handle 5 is rotatably mounted on the handle mounting portion 2-7.

The positioning rib 2-8 which performs positioning between the developer supply case 1 and the hopper 10 and the guide rail 2-9 guided by the case guide 17 of the hopper 10 are provided on both side surfaces of the case body 2. The incompatible rib 2-10 is also provided on the side surface. A combination of the incompatible rib 2-10 and the incompatible attachment 18 of the hopper 10 allows the devices or colors of the developer supply case 1 to be incompatible.

The step rib 2-11 as an inserting load causing unit is provided on the top surface of the case body 2. The function of the step rib 2-11 will be described later in detail.

(Shutter)

Figure 5A:
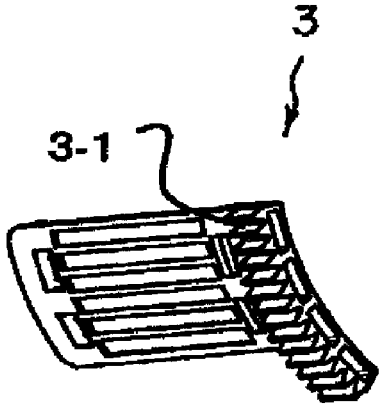
FIG. 5A is a front perspective view of a shutter according to the first embodiment and FIG. 5B is a rear perspective view of the shutter according to the first embodiment.
Figure 5B:
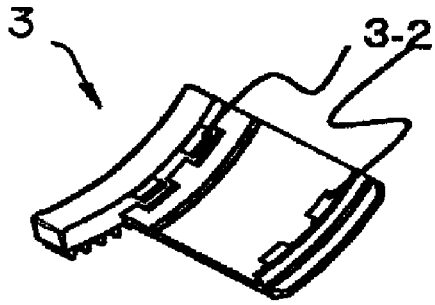

The shutter 3 will be described using FIGS. 5A and 5B. FIG. 5A is a front perspective view of the shutter 3, and FIG. 5B is a rear perspective view of the shutter 3.

The shutter 3 is slidably fixed to the case body 2 by engaging the shutter guide 2-2 of the case body 2 with a shutter claw 3-2 provided in the shutter 3. Before the developer is supplied, the shutter 3 is in the position sealing the supply opening 2-1. When the developer is supplied to the hopper 10, a gear 3-1 provided at one end of the shutter 3 receives rotational drive from the drive relay gear 12 provided in the hopper 10. The shutter 3 is slid in the opening direction along the shutter guide 2-3 of the case body 2 to open the developer supply opening 2-1.

After the developer in the developer supply case 1 is used up, the gear 3-1 receives rotational drive opposite to that at opening from the drive relay gear 12. The shutter 3 is slid to the position sealing the developer supply opening 2-1 to seal the same.

(Handle)

Figure 6A:
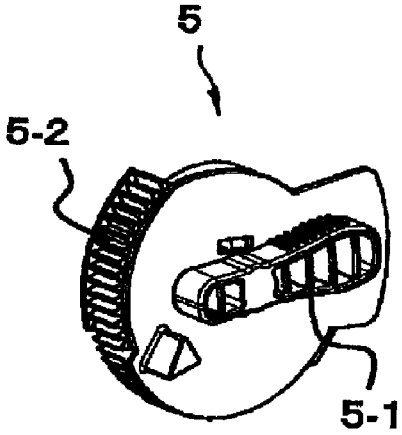
FIG. 6A is a front perspective view of a handle according to the first embodiment and FIG. 6B is a rear perspective view of the handle according to the first embodiment.
Figure 6B:
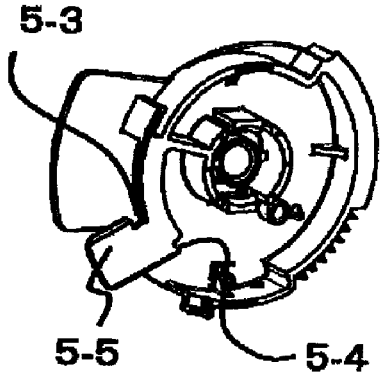

The handle 5 will be described using FIGS. 6A and 6B. FIG. 6A is a front perspective view of the handle 5, and FIG. 6B is a rear perspective view of the handle 5.

The handle 5 is rotatably mounted on the handle mounting portion 2-7 of the case body 2. The handle 5 has an operation portion 5-1 on the front surface and a gear 5-2 on the side surface. The user rotationally operates the operation portion 5-1 to rotate the handle 5. The rotational drive is transmitted from the gear 5-2 to the drive relay gear 12 provided in the hopper 10.

In this embodiment, the shutter 3 and the handle 5 are provided separately. The shutter 3 and the handle 5 may be provided as a single member. In this case, because drive of the handle 5 is not required to be transmitted to the shutter 3, the gear 3-1 provided in the shutter 3 and the gear 5-2 provided in the handle 5 are unnecessary. The drive relay gear 12 provided in the hopper 10 is also unnecessary.

The handle 5 has a lock portion which regulates sealing release of the shutter 3 so as to prevent the user from operating the operation portion 5-1 by mistake. As illustrated in FIG. 6B, the lock portion has an opening direction engaging portion 5-3, a sealing direction engaging portion 5-4, and a lock releasing portion 5-5. The handle lock opening engaged portion 2-7-1 provided in the case body 2 and the opening direction engaging portion 5-3 are engaged with each other. The handle lock sealing engaged portion 2-7-2 and the sealing direction engaging portion 5-4 are engaged with each other. The handle 5 is engaged so as not to be rotated in both the opening direction and the sealing direction.

The lock releasing portion 5-5 as an engaging portion receives the action of the hopper 10 in insertion of the developer supply case 1 into the hopper 10. Specifically, when the developer supply case 1 is inserted into the hopper 10, the lock releasing portion 5-5 is displaced to the opposite side of the inserting direction by the projection 14 (see FIG. 3A) of the hopper 10 as an engaged portion. The engagement of the lock engaging portions 5-3 and 5-4 of the handle 5 with the engaged portions 2-7-1 and 2-7-2 of the case body 2 is released to rotate the handle 5.

(Coupling)

Figure 7A:
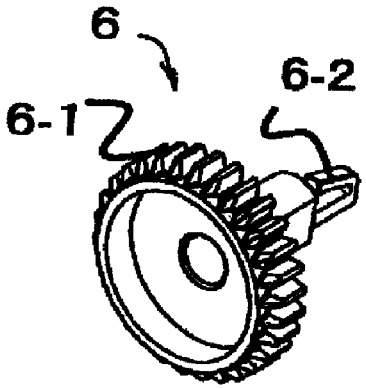
FIG. 7A is a front perspective view of a coupling according to the first embodiment and FIG. 7B is a rear perspective view of the coupling according to the first embodiment.
Figure 7B:
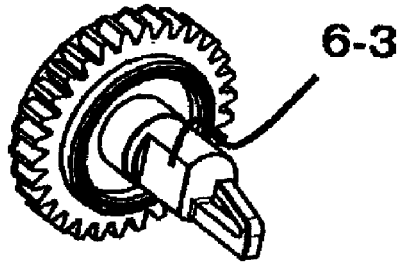

The coupling 6 will be described using FIGS. 7A and 7B. FIG. 7A is a front perspective view of the coupling 6, and FIG. 7B is a rear perspective view of the coupling 6.

The coupling 6 has the function of transmitting drive of the hopper 10 to the agitating member (not illustrated) provided in the case body 2. A gear 6-1 is provided on the circumferential surface of the coupling 6. The coupling 6 is engaged with the agitating member (not illustrated) by a claw 6-2 provided in the center position of rotation in the thrust direction. The coupling 6 is engaged with the agitating member (not illustrated) in the rotation direction by a D cut portion 6-3 in which part of an axial portion is cut, thereby transmitting rotational drive.

[Insertion of the Developer Supply Case]

Figure 8A:
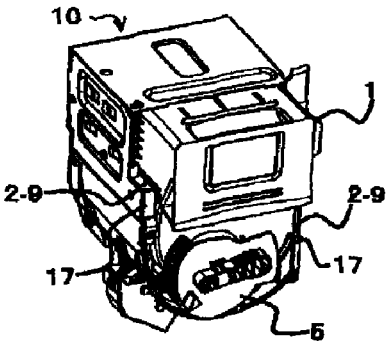
Figure 8B:
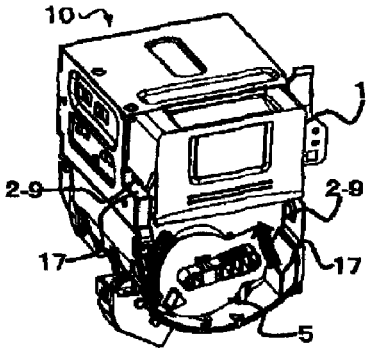
Figure 8C:
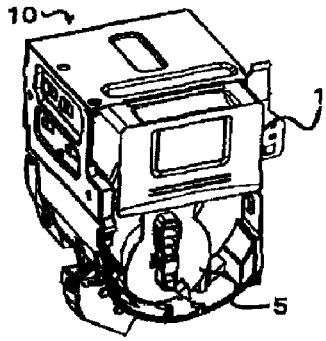

The state of inserting the developer supply case 1 into the hopper 10 to supply the developer will be described using FIGS. 8A, 8B, and 8C. FIG. 8A is a perspective view illustrating the state while the developer supply case 1 is being inserted, FIG. 8B is a perspective view illustrating the state after the developer supply case 1 is completely pushed, and FIG. 8C is a perspective view illustrating the state after the handle 5 is rotated.

In FIG. 8A, the user holds the holding portion 2-6 of the case body 2, pushes it from the front side of the hopper 10 into the back side, and inserts the developer supply case 1 into the hopper 10. The guide rail 2-9 is guided by the case guide 17 so that the developer supply case 1 is pushed from the front side into the back side of the hopper 10 for insertion. After the developer supply case 1 is completely inserted into the hopper 10 by the user, he/she holds the operation portion of the handle to rotationally operate the handle 5 in the arrow direction illustrated in FIG. 8B. FIG. 8C illustrates the state after the handle 5 is rotated.

Figure 9A:
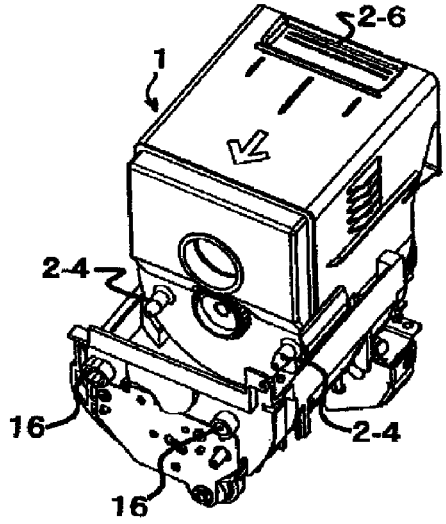
Figure 9B:
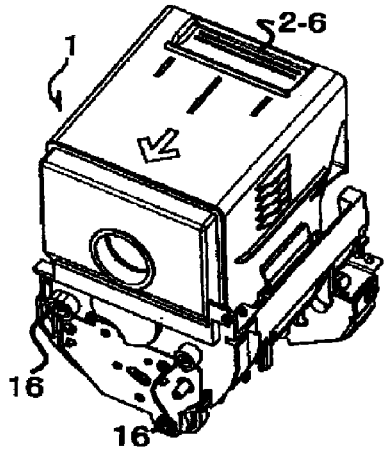

When the developer supply case 1 is inserted into the hopper 10, the positioning hole 16 as a positioned portion provided in the hopper 10 and the positioning pin 2-4 as a positioning portion of the developer supply case 1 are fitted to each other. The positioning hole 16 and the positioning pin 2-4 are fitted to each other at completion of insertion of the developer supply case 1 into the hopper 10. The end face of the developer supply case 1 on the back side in the inserting direction is positioned in and fixed to the hopper 10. FIGS. 9A and 9B illustrate the state. FIG. 9A illustrates the state while the developer supply case 1 is being inserted, and FIG. 9B illustrates the state after the developer supply case 1 is inserted.

The end face of the developer supply case 1 is fixed to the hopper 10 by fitting the positioning hole 16 and the positioning pin 2-4 to each other. At drive transmission, the gear jumping can be prevented by regulating the center distance between the agitating gear 15 of the hopper 10 and the coupling gear 6-1 of the coupling 6. The fitting dimension relation is employed for fitting the positioning hole 16 and the positioning pin 2-4 to each other so as to suppress looseness. An inserting load W is increased for fitting the positioning hole 16 and the positioning pin 2-4 to each other.

Figure 10A:
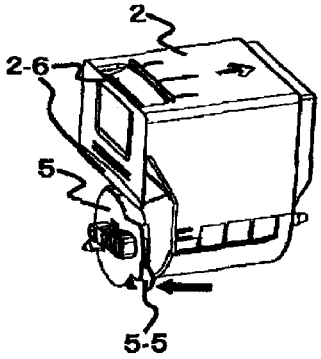
Figure 10B:
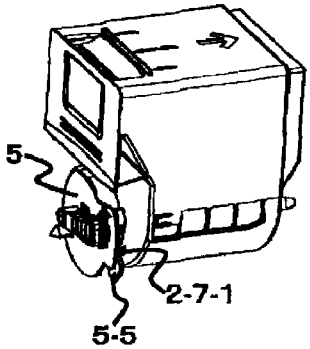

The lock of the lock portion provided in the handle 5 is released by inserting the developer supply case 1 into the hopper 10. The state will be described using FIGS. 10A, 10B, and 10C. FIG. 10A illustrates the state that the handle 5 and the case body 2 are engaged with each other (the state that lock portion is locked). While the developer supply case 1 is being inserted into the hopper 10 in the state of FIG. 10A, the projection 14 (see FIG. 3A) as an engaged portion of the hopper 10 and the lock releasing portion 5-5 as an engaging portion of the handle 5 abut each other. While the developer supply case 1 is being inserted toward the back side in this state, the lock releasing portion 5-5 is displaced to the opposite side of the inserting direction, that is, in the arrow direction of FIG. 10A. The engagement of the engaging portions 5-3 and 5-4 (see FIG. 6A) of the handle 5 with the engaged portions 2-7-1 and 2-7-2 (see FIG. 4A) of the case body 2 is released so that the handle 5 can be rotated. In this embodiment, the displacement of the sealing direction engaging portion 5-4 is 1 mm. FIG. 10B illustrates this state. The position where the projection 14 of the hopper 10 and the lock releasing portion 5-5 of the handle 5 abut each other is set to a distance of 2 mm before the inserting completion position of the developer supply case 1.

Figure 10C:
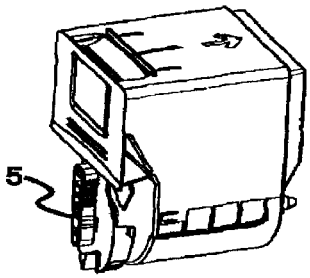

The handle 5 in this state is rotated by the user in the arrow direction of FIG. 10B. FIG. 10C illustrates this state. The handle 5 is rotated so that its rotational drive is transmitted via the drive relay gear 12 to the shutter 3. The shutter 3 is then slid in the opening direction. As described later, upon the slide of the shutter 3, the hopper shutter 11 is also slid. The developer receiving opening 11-1 provided in the hopper shutter 11 and the supply opening 2-1 of the case body 2 coincide with each other. The developer stored in the case body 2 is supplied to the hopper 10.

The resinous spring characteristic of the lock portion is used for engagement and release of the lock portion of the handle 5. It is necessary to release the handle lock against the spring characteristic of the lock releasing portion 5-5. The inserting load W is increased upon release of the handle lock.

(Operation of the Shutter)

Figure 11A:
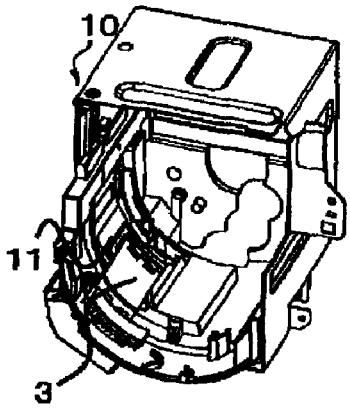
Figure 11B:
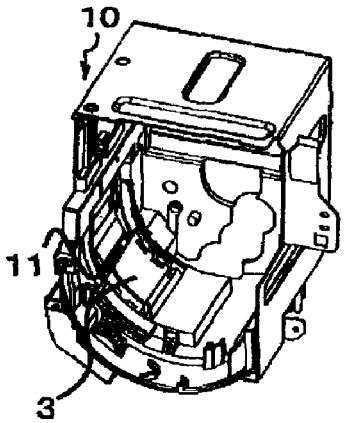
Figure 11C:
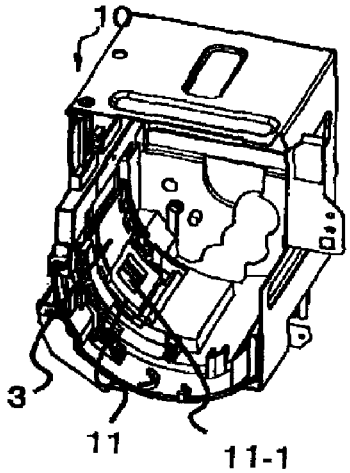

The operation of the shutter 3 as a sealing member will be described using FIGS. 11A, 11B, and 11C. FIGS. 11A to 11C illustrate only the hopper 10 and the shutter 3 of the developer supply case 1. FIG. 11A is a perspective view illustrating the state while the developer supply case 1 is being inserted. FIG. 11B is a perspective view illustrating the state after the developer supply case 1 is completely inserted and the shutter 3 and the hopper shutter 11 are completely fitted to each other. FIG. 11C is a perspective view illustrating the state after the shutter 3 and the hopper shutter 11 are slid to open the developer receiving portion by the developer receiving opening 11-1.

In FIG. 11A, in insertion of the developer supply case 1 into the hopper 10, the shutter 3 is fitted to the hopper shutter 11 of the hopper 10 for attachment. The end face of the shutter 3 abuts the abutment surface of the hopper to complete attachment. FIG. 11B illustrates this state. In this state, the position of the supply opening 2-1 of the case body 2 and the position of the developer receiving opening 11-1 of the hopper shutter 11 coincide with each other in the inserting direction.

The handle 5 is rotated to rotate the shutter 3. Because the shutter 3 and the hopper shutter 11 are fitted to each other, the shutter 3 is slid in the opening direction. The hopper shutter 11 is also slid. The developer receiving opening 11-1 of the hopper shutter and the supply opening 2-1 coincide with each other. The developer can be supplied from the developer supply case 1 to the hopper 10.

(Step Rib)

Figure 12A:
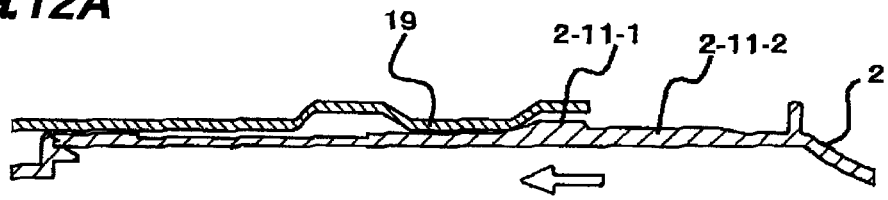
Figure 12B:
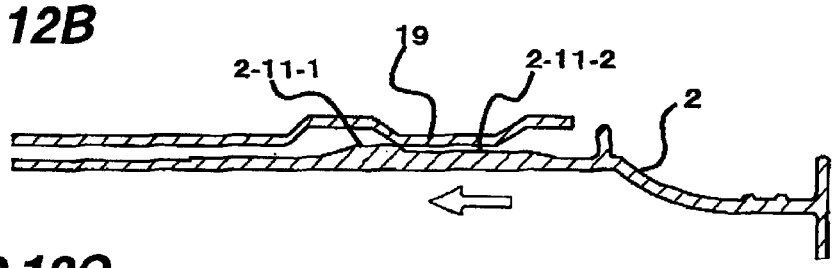
Figure 12C:
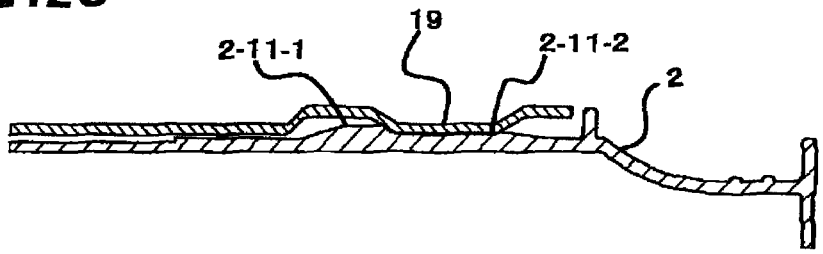

The step rib 2-11 as an inserting load causing unit which causes the inserting load in insertion of the developer supply case 1 into the apparatus body will be described. FIGS. 12A, 12B, and 12C are cross-sectional views illustrating the state of the interference (contact) between the step rib 2-11 and the positioning rib 19, in which FIGS. 12A and 12B illustrate the state while the developer supply case 1 is being inserted and FIG. 12C illustrates the state after the developer supply case 1 is inserted.

As described above, the developer supply case of this embodiment has the step rib 2-11 as a projection on the top surface of the case body 2. As illustrated in FIGS. 12A, 12B, and 12C, the step rib 2-11 has a tall rib 2-11-1 and a short rib 2-11-2 which are projected from the top surface of the case body 2 and have different heights. In the process of inserting the developer supply case 1 into the hopper 10, the step rib 2-11 interferes (contacts) with the positioning rib 19 provided in the hopper 10. By the interference, the developer supply case 1 is inserted while being deformed. By the frictional force caused at this time, the inserting load necessary for inserting the developer supply case 1 into the hopper 10 is increased. The change of the inserting load at this time will be described for each of the states of FIGS. 12A, 12B, and 12C.

(A) State:

The user inserts the developer supply case 1 into the hopper 10 by holding the holding portion 2-6 of the case body 2. FIG. 12A illustrates the state that the developer supply case 1 reaches at the point where the tall rib 2-11-1 of the step rib 2-11 interferes with the positioning rib 19. In this embodiment, the position in the (A) state that the tall rib 2-11-1 starts to interfere with the positioning rib 19 is set to a distance of 15 mm before the inserting completion position.

The user feels the inserting load by the interference between the tall rib 2-11-1 and the positioning rib 19 at this point. The position in the (A) state is at a distance of 15 mm before the inserting completion position. The user cannot misunderstand that the insertion is completed. An inserting load P1 at this time is adjusted to about 2 to 3 kgf which is equal to or more than the inserting load W. The user feels the inserting load, but can continuously perform the inserting operation.

The distance in which the user does not misunderstand the inserting completion is experimentally checked. When the inserting completion position is clear, about 5 mm before the inserting completion position is enough. When the inserting completion position is not clear, about 10 mm is necessary. The user cannot misunderstand the inserting completion at a distance of 15 mm before the inserting completion position of this embodiment.

(B) State:

The user continuously inserts the developer supply case 1 into the hopper 10 from the (A) state. FIG. 12B illustrates the state that the developer supply case 1 reaches the point at which the interference between the tall rib 2-11-1 and the positioning rib 19 is ended. When the user pushes the developer supply case 1 in this state, the interference between the tall rib 2-11-1 and the positioning rib 19 is gradually eliminated. The inserting load at this time is decreased from P1 to P2. In this embodiment, the position in the (B) state is set to a distance of 2 mm before the inserting completion position.

(C) State:

The user continuously inserts the developer supply case 1 into the hopper 10 from the (B) state. FIG. 12C illustrates the state after the developer supply case 1 is completely inserted into the hopper 10. At this point, the tall rib 2-11-1 has completely passed through the positioning rib 19. The positioning rib 19 interferes with the short rib 2-11-2. By the interference, the developer supply case 1 is fixed to the hopper 10.

In the process of inserting the developer supply case 1 into the hopper 10, as described above, the inserting load causing factors which increase the inserting load are: (1) the lock releasing force of the lock portion provided in the handle 5, and (2) the fitting force of the positioning pin 2-4 and the hopper side fitting hole 16. The two inserting load causing positions are set to the points from the (B) state to the (C) state. The difference in height between the tall rib 2-11-1 and the short rib 2-11-2 of the step rib 2-11 is set in such a manner that a load having a magnitude equal to or more than that of the two inserting loads previously measured is decreased in the process from the (B) state to the (C) state.

In this embodiment, as specific dimensions, the height of the tall rib 2-11-1 is set to 1.3 mm and the height of the short rib 2-11-2 is set to 0.8 mm. The difference in height between both ribs is 0.5 mm. The change of the inserting load by the step rib 2-11 from the interference between the positioning rib 19 and the tall rib 2-11-1 to the interference between the positioning rib 19 and the short rib 2-11-2 is measured using a push-pull gauge (spring balance). This measurement is performed by reading a value indicated by the gauge when the developer supply case 1 is pushed by the push-pull gauge in the direction inserting it into the hopper 10. The inserting load P1 is 2.5 kgf at the interference between the positioning rib 19 and the tall rib 2-11-1. The inserting load P2 of the short rib 2-11-2 after the tall rib 2-11-1 passes through the positioning rib 19 is 1.5 kgf. In other words, it is observed that the inserting load is decreased by about 1.0 kgf. The total of (1) the lock releasing force of the lock portion provided in the handle 5 and (2) the force necessary for fitting the positioning pin 2-4 and the hopper side fitting hole 16 to each other, that is, the inserting load W, is about 0.7 kgf.

In this embodiment, the relation between the loads applied for insertion of the developer supply case is set to $P1 \geqq P2+W$. When the inserting operation of the developer supply case 1 from the (B) state to the (C) state is performed, the user cannot feel the inserting load increase due to (1) the lock releasing force of the lock portion provided in the handle 5 and (2) the fitting of the positioning pin 2-4 and the hopper side fitting hole 16. The user completely inserts the developer supply case 1 into the hopper 10 without stopping the inserting operation.

Figure 13:
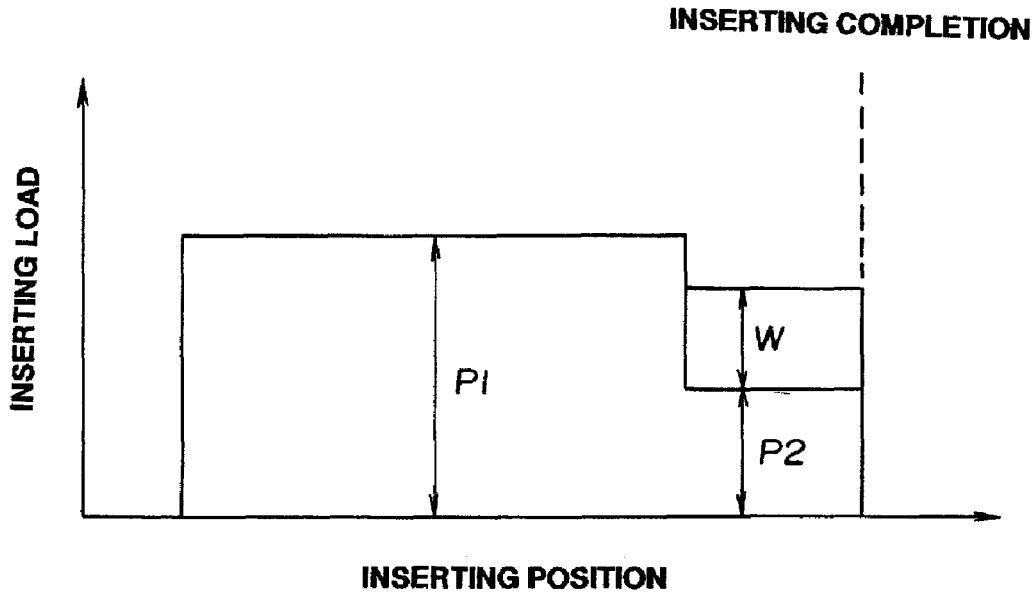
FIG. 13 is a graph illustrating the relation between inserting loads (P1, P2, and W) and the inserting positions.

FIG. 13 illustrates a graph schematically illustrating the relation between the inserting loads and the inserting positions according to this embodiment. In the graph illustrated in FIG. 13, the vertical axis indicates the inserting loads, the horizontal axis indicates the inserting positions, the right direction of the horizontal axis indicates the inserting direction, and the dotted line indicates the inserting completion position.

As illustrated in the graph, it is designed so that the inserting load is lowered from P1 to P2 according to the position where the inserting load W is caused. The user can insert the developer supply case into the inserting completion position without feeling the increased inserting load W.

In this embodiment, there is described the constitution having the two inserting load causing factors of (1) the lock releasing force of the lock portion provided in the handle 5 and (2) the force necessary for fitting the positioning pin 2-4 and the hopper side fitting hole 16 to each other. There are not necessarily two inserting load causing factors. Only one of the factors can exhibit the operation and effect of this embodiment.

Figure 14:
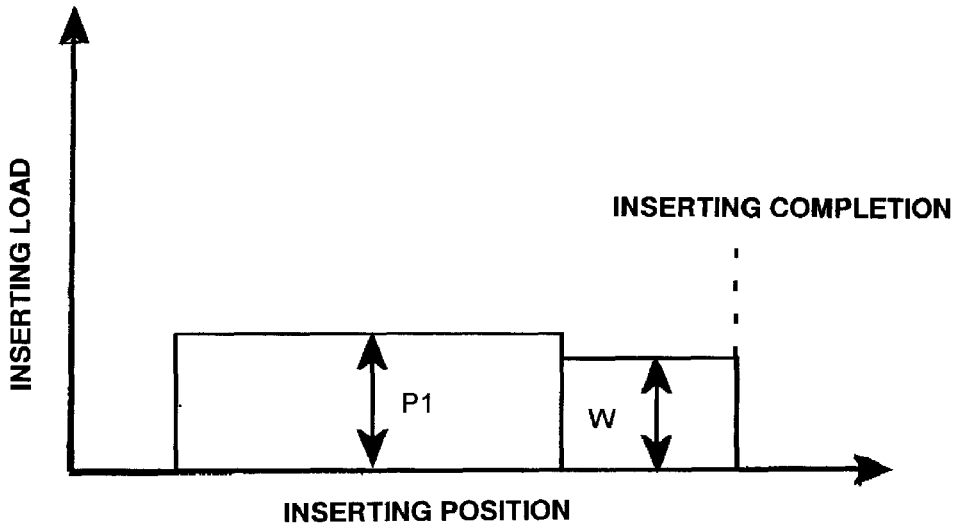
FIG. 14 is a graph illustrating the inserting loads when a short rib is not used.

In this embodiment, the step rib 2-11 is used as the inserting load causing unit. The inserting load P2 by the short rib 2-11-2 may be zero without providing the short rib 2-11-2. In this case, the inserting load W and the inserting load P1 satisfy the relation of P1≧W. FIG. 14 illustrates this state.

Figure 15:
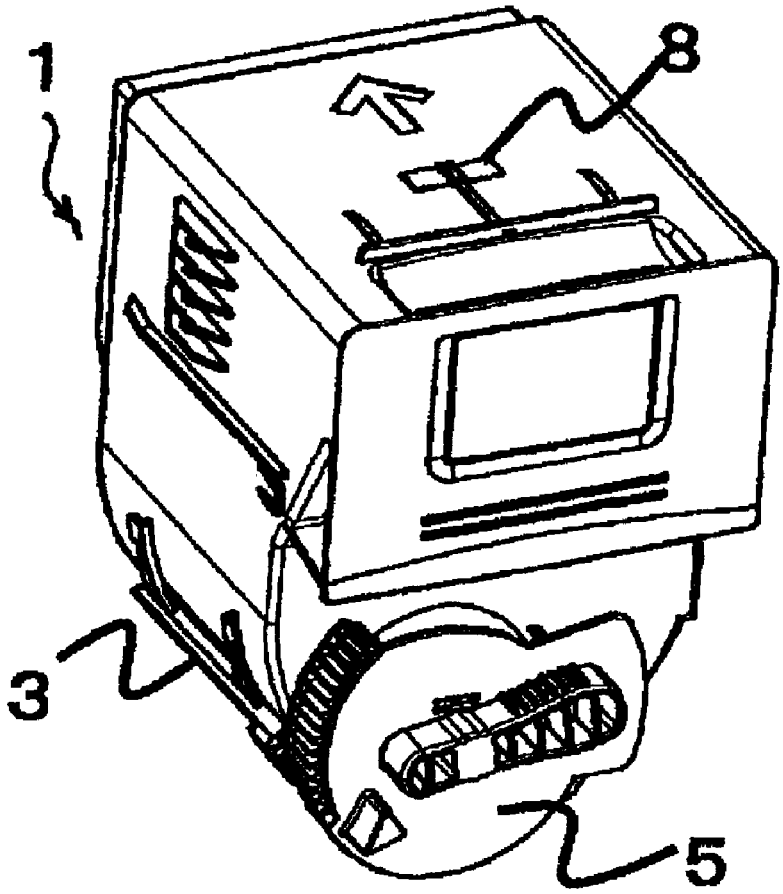
FIG. 15 is a diagram illustrating an example using a friction member.
Figure 16:
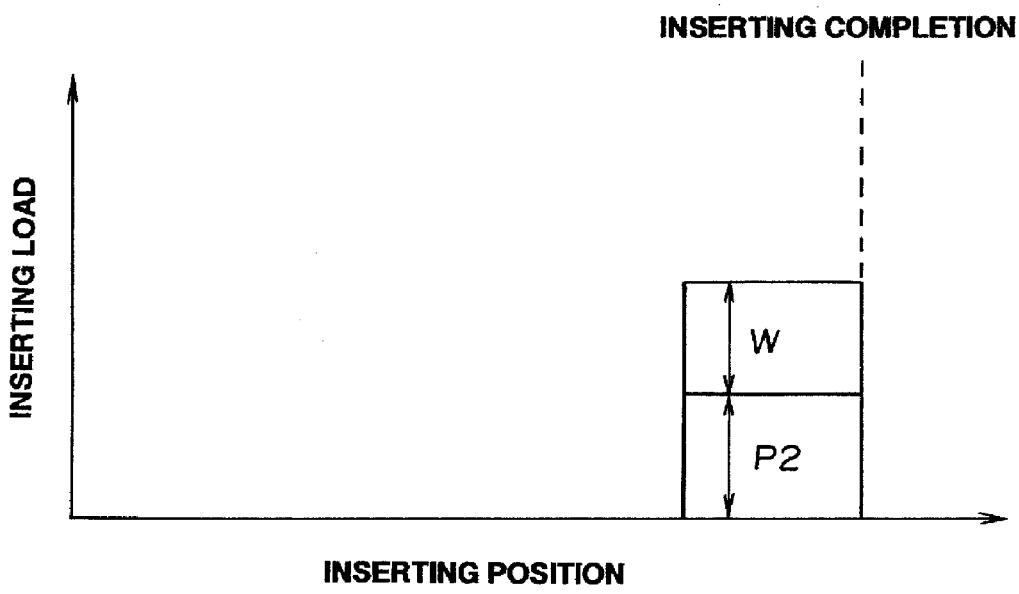
FIG. 16 is a graph illustrating the relation between the inserting loads (P2 and W) and the inserting positions.

In place of the step rib 2-11, a seat or a different member may be provided. FIG. 15 illustrates the constitution of the developer supply case 1 provided with the different member. In FIG. 15, a friction member 8 is a friction member which interferes with the positioning rib 19 and has a predetermined coefficient of friction.

The friction member 8 is provided in the position corresponding to the tall rib 2-11-1 of the step rib 2-11. Its thickness is 0.5 mm. PET is used as its material. Almost the same result as that of the step rib 2-11 can be obtained. The coefficient of friction of the friction member 8 with the positioning rib 19 can be adjusted using various materials. The amount of change of an arbitrary inserting strength can be measured. The degree of freedom of the design can be improved using the friction member as the member different from the case body.

Comparative Example

Figure 17:
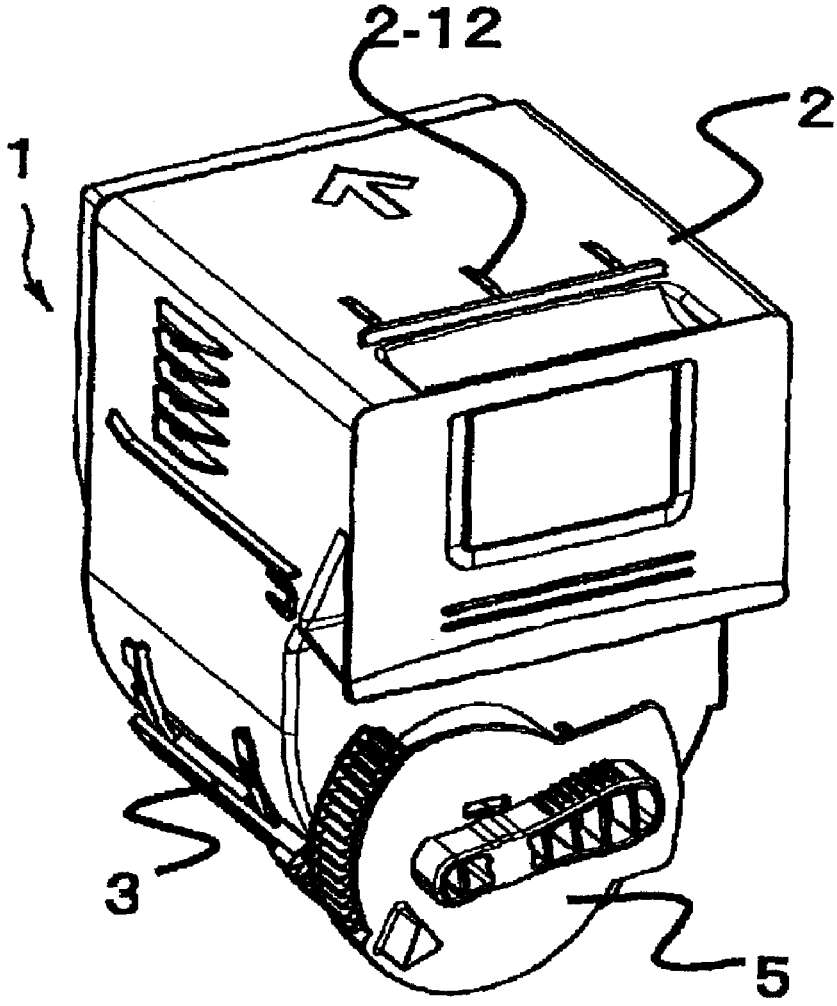
FIG. 17 is a perspective view of the developer supply case according to a comparative example.
Figure 18A:
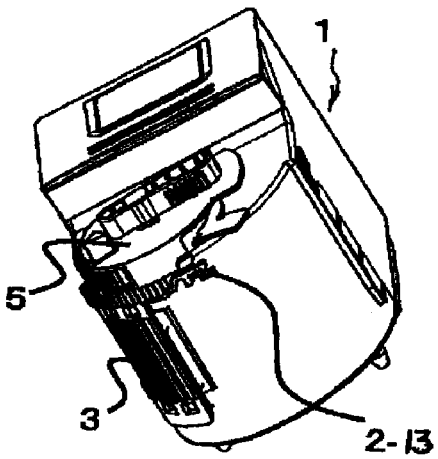
FIG. 18A is a perspective view of the developer supply case according to a second embodiment and FIG. 18B is a perspective view of the shutter according to the second embodiment.
Figure 18B:
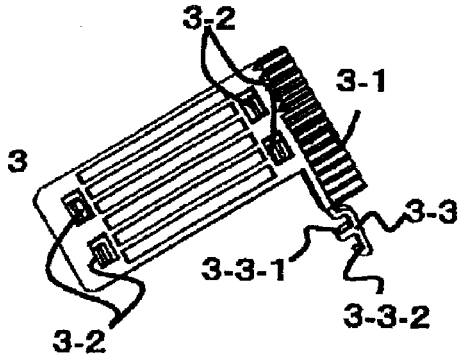

FIG. 17 illustrates the constitution of the developer supply case 1 without the step rib 2-11 as a comparative example. In FIG. 17, a rib 2-12 corresponding to the short rib 2-11-2 of the step rib 2-11 is provided on the top surface of the developer supply case 1. In this case, the inserting force is increased by 0.3 kgf by the interference between the rib 2-12 and the positioning rib 19. The interference between the rib 2-12 and the positioning rib 19 occurs at a distance of 2 mm before the inserting completion position.

In insertion of the developer supply case 1 illustrated in the comparative example into the hopper 10, the following three loads are applied at a distance of 2 mm before the inserting completion position: (1) the lock releasing force of the lock portion provided in the handle 5, (2) the inserting load by fitting the positioning pin 2-4 and the hopper side fitting hole 16 to each other, and (3) the inserting load by the interference between the rib 2-12 and the positioning rib 19. By increase of the three loads, the load is increased by about 1.0 kgf. The user can misunderstand the inserting completion at a distance of 2 mm before the inserting completion position to stop the inserting operation. Actually, it is observed that two of ten people stop insertion before the inserting completion position.

FIG. 15 illustrates a graph schematically illustrating the relation between the inserting loads and the inserting positions of the developer supply case 1 illustrated in the comparative example. In the graph illustrated in FIG. 15, the vertical axis indicates the inserting loads, the horizontal axis indicates the inserting positions, the right direction of the horizontal axis indicates the inserting direction, and the dotted line indicates the inserting completion position.

As illustrated in the graph, the inserting loads W and P2 are caused before the inserting completion position. Due to the loads, the possibility that the user can stop insertion before the inserting completion position, that is, in the position where W and P2 are caused, is high.

As described above, before engagement of the engaging portion in insertion of the developer supply case 1 into the image forming apparatus body, a load larger than that caused by the engagement is caused. The inserting load is set to be unchanged or smaller than that at engagement of the engaging portion such that the user cannot feel it. The user cannot misunderstand the inserting completion before engagement of the engaging portion.

The inserted developer supply case 1 is positioned and fixed to prevent scattering of the developer due to rattle in the developer supply case.

Sealing of the shutter 3 is locked by the lock portion before insertion. The shutter 3 cannot be opened by mistake. The false operation of the operation portion 5-1 can be prevented.

Second Embodiment

The apparatus according to the second embodiment will be described with reference to FIG. 19. The basic constitution of the apparatus of this embodiment is the same as that of the above embodiment and the overlapped description is omitted. The constitution as the feature of this embodiment will be described here. The members having the same functions as those of the above embodiment are indicated by similar reference numerals.

As in the first embodiment, the developer supply case 1 illustrated in this embodiment has the case body 2, the shutter 3, the packing material 4, the handle 5, the coupling 6, and the inside stopper 7.

The shutter 3 illustrated in this embodiment has a lock portion which regulates the position until the developer supply case 1 is inserted into the hopper 10.

Figure 19A:
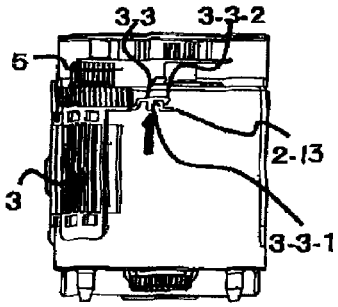
Figure 19B:
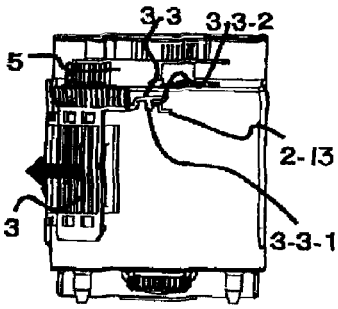

The developer supply case 1 of this embodiment will be described using FIGS. 19A and 19B. FIG. 19A is a perspective view of the developer supply case 1 according to this embodiment, and FIG. 19B is a perspective view of the shutter 3 according to this embodiment. The case body 2 according to this embodiment has a lock engaged portion 2-13 which is engaged with a shutter lock portion 3-3 of the shutter 3. The shutter 3 has the shutter lock portion 3-3. The shutter lock portion 3-3 has a releasing portion 3-3-1 and an engaging portion 3-3-2.

In the state that the engaging portion 3-3-2 is in the position where the shutter 3 seals the supply opening 2-1, it is engaged with the lock engaged portion 2-13 to regulate the slide of the shutter 3 in the opening direction.

Figure 19C:
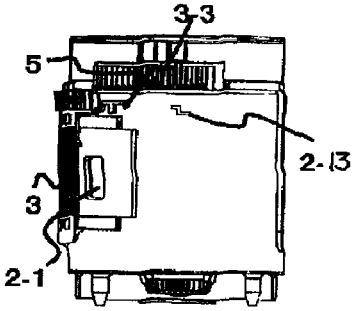

The constitution of the shutter lock release of the shutter 3 will be described using FIGS. 19A, 19B, and 19C. FIG. 19A illustrates the state that the shutter 3 is in the position sealing the supply opening 2-1. FIG. 19B illustrates the state after the developer supply case 1 is inserted into the hopper 10 and the shutter lock portion 3-3 is displaced in the arrow direction of FIG. 19A by the projection of the hopper. FIG. 19C illustrates the state after the shutter 3 is rotated to open the supply opening 2-1.

As in the first embodiment, the developer supply case 1 is inserted into the hopper 10. The projection 13 (see FIG. 3) as an engaged portion is provided in the position corresponding to the releasing portion 3-3-1 of the shutter 3 of the hopper 10. By interlocking with the inserting operation of the developer supply case 1, the projection 13 and the releasing portion 3-3-1 as an engaging portion of the shutter 3 abut each other to release the engagement of the shutter lock engaging portion 3-3-2 with the lock engaged portion 2-13 of the case body 2. The resinous spring characteristic of the shutter lock portion 3-3 is used for the engagement and release of the shutter lock engaging portion 3-3-2 and the lock engaged portion 2-13. The shutter lock need to be released against the spring characteristic of the shutter lock portion 3-3.

In the process of inserting the developer supply case 1 into the hopper 10, the shutter lock is released. The inserting load necessary for the release is increased. The developer supply case according to this embodiment has the same rib as the step rib 2-11 illustrated in the first embodiment. The position releasing the shutter lock is set between the states illustrated in FIGS. 12B and 12C.

The actually measured force releasing the shutter lock is about 0.3 kgf. By totaling it and the inserting load increase factors (0.7 kgf) in the first embodiment, the inserting load is increased by about 1.0 kgf. In this embodiment, the same step rib 2-11 as that of the first embodiment is provided. The inserting load is decreased by about 1.0 kgf from the state of FIG. 12B to the state of FIG. 12C.

In this embodiment, the inserting load W applied to engagement includes the following (1) to (3): (1) the inserting load of the lock releasing force of the lock portion provided in the handle 5, (2) the inserting load by fitting the positioning pin 2-4 and the hopper side fitting hole 16 to each other, and (3) the inserting load of the lock releasing force of the shutter lock. When performing the inserting operation of the developer supply case 1 from the state of FIG. 12B to the state of FIG. 12C, the user can completely insert the developer supply case 1 into the hopper 10 without feeling the increased inserting load W according to the engagement.

Third Embodiment

In the above embodiment, the developer supply case is illustrated as the inserting member inserted into the inserted portion. The inserting member need not be limited to the developer supply case. Any inserting member which causes the inserting load by engagement immediately before it is completely inserted into the inserted portion is applicable. In this case, before engagement of the engaging portion, a load larger than that caused by the engagement is caused and the inserting load is set to be changed such that the user cannot feel the load at engagement of the engaging portion. The user cannot misunderstand the inserting completion before engagement of the engaging portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-040158, filed Feb. 21, 2007, which is hereby incorporated by reference herein in its entirety.

What is claimed is:

1. A developer supply container detachably mountable to an image forming apparatus, said container being set by a setting operation including a manually inserting operation into an insertion portion of the image forming apparatus, said container comprising:

a container body having an inner space configured and positioned to contain developer, an opening configured and positioned to permit discharge of the developer out of said container body, and a first locked portion;

a shutter configured and positioned to open and close said opening, said shutter having a locking portion configured and positioned to lock with said first locked portion of said container body, said locking portion being releasable from said first locked portion with elastic deformation of said locking portion by abutting with the insertion portion at an end of the inserting operation; and an insertion load causing portion configured and positioned to cause an insertion load by sliding contact with the insertion portion during the inserting operation, wherein the insertion load, which is caused by said insertion load causing portion, for the inserting operation before a releasing operation of said locking portion at the end of the inserting operation is performed is larger than an insertion load for the inserting operation during the releasing operation.

2. The container according to claim 1, further comprising a manually operating portion configured and positioned to be usable in an operation for opening and closing said shutter, said operating portion having a locking portion configured and positioned to lock with a second locked portion of said container body, said locking portion of said operating portion being releasable from said second locked portion with elastic deformation of said locking portion by abutting with the insertion portion at the end of the inserting operation, wherein the insertion load caused by said insertion load causing portion is not smaller than a sum of the releasing load and a releasing load for a releasing operation of said locking portion of said operating portion from said second locked portion.

3. The container according to claim 2, further comprising two pins configured and positioned to enter into two hollow portions of the image forming apparatus while sliding contact with inner surfaces of the two hollow portions at the end of the inserting operation, respectively, wherein the insertion load caused by said insertion load causing portion is not smaller than a sum of two of the releasing load and an entering load for an entering operation of said two pins into the two hollow portions.

4. The container according to claim 1, wherein said insertion load causing portion includes a projection provided on a top surface of said container body.

5. The container according to claim 1, wherein said insertion load causing portion is provided on said container body so as to eliminate the insertion load with the releasing operation.

6. A developer supply container detachably mountable to an image forming apparatus, said container being set by a setting operation including a manually inserting operation into an insertion portion of the image forming apparatus, said container comprising:

a container body having an inner space configured and positioned to contain developer, an opening configured and positioned to permit discharge of the developer out of said container body and a locked portion;

a shutter configured and positioned to open and close said opening;

a manually operating portion configured and positioned to be usable in an operation for opening and closing said shutter, said operating portion having a locking portion configured and positioned to lock with said locked portion, said locking portion of said operating portion being releasable from said locked portion with elastic deformation of said locking portion by abutting with the insertion portion at an end of the inserting operation; and an insertion load causing portion configured and positioned to cause an insertion load by sliding contact with the insertion portion during the inserting operation, wherein the insertion load, which is caused by said insertion load causing portion, for the inserting operation before a releasing operation of said locking portion at the end of the inserting operation is performed is larger than an insertion load for the inserting operation during the releasing operation.

7. The container according to claim 6, wherein said insertion load causing portion includes a projection provided on a top surface of said container body.

8. The container according to claim 6, wherein said insertion load causing portion is provided on said container body so as to eliminate the insertion load with the releasing operation.

* * * * *